US005820066A

United States Patent [19]

Jaramillo et al.

[11] Patent Number: 5,820,066

[45] Date of Patent: Oct. 13, 1998

[54] METHODS AND APPARATUS FOR LAYING FLUID DISTRIBUTION LINES

[75] Inventors: Ramon G. Jaramillo, Santa Clara; Gregory E. Collins, Tyrone; Jose G. Cruz, Santa Clara; Frank Aragon; William J. Gordon, both of Silver City; David M. Castañon, Bayard, all of N. Mex.

[73] Assignee: Phelps Dodge Corporation, Phoenix, Ariz.

[21] Appl. No.: 857,297

[22] Filed: May 16, 1997

[51] Int. Cl.[6] ..... B65H 49/00

[52] U.S. Cl. ..... 242/557; 266/101; 137/236.1; 137/355.26

[58] Field of Search ..... 242/557; 239/736, 239/751, 752, 753; 137/236.1, 355.16, 355.17, 355.26; 254/134.3 R; 266/101; 75/712; 104/173.1, 173.2; 212/76, 77, 83, 93, 98

[56] References Cited

U.S. PATENT DOCUMENTS

| | | | |
|---|---|---|---|
| 1,089,264 | 3/1914 | Putman . | |
| 2,371,887 | 3/1945 | Hamilton . | |
| 3,247,933 | 4/1966 | Hanna | 188/137 |
| 3,477,652 | 11/1969 | Crowley | 242/557 |
| 3,596,878 | 8/1971 | Parsen | 254/134.3 R |
| 3,628,728 | 12/1971 | Polutnik et al. | 239/159 |
| 3,713,547 | 1/1973 | Beck . | |
| 3,995,355 | 12/1976 | Sneed et al. | 254/134.3 R |
| 4,164,289 | 8/1979 | Haliewicz | 212/122 |
| 4,365,927 | 12/1982 | Schenck | 414/729 |
| 4,586,677 | 5/1986 | Nevarez . | |
| 4,614,584 | 9/1986 | Di Duen | 137/236.1 |
| 4,662,525 | 5/1987 | Bottem | 212/76 |
| 4,981,268 | 1/1991 | Hour | 239/751 |
| 5,020,443 | 6/1991 | Gauthier | 104/230 |
| 5,030,279 | 7/1991 | Kranth | 266/101 |
| 5,738,294 | 4/1998 | Yasnegorodskiy | 242/557 |

*Primary Examiner*—John M. Jllions
*Attorney, Agent, or Firm*—Fish & Neave; Robert R. Jackson; Brian M. Dugan

[57] ABSTRACT

Methods and apparatus for laying fluid distribution lines along a surface are disclosed. An overhead support cable is secured between a plurality of anchoring devices spaced along the surface. A rotatable installation reel is then coupled to the overhead support cable and a coil of fluid distribution line is loaded on the installation reel. Fluid distribution line is laid along the surface by moving the installation reel along the overhead support cable so as to rotate the installation reel to pay out the fluid distribution line along the surface. Subsequent fluid distribution lines may be laid at substantially equal lateral spacings by moving each anchoring device or a portion of each anchoring device prior to laying each subsequent fluid distribution line.

29 Claims, 6 Drawing Sheets

METHODS AND APPARATUS FOR LAYING FLUID DISTRIBUTION LINES

BACKGROUND OF THE INVENTION

This invention relates to methods and apparatus for laying fluid distribution lines along a surface. Examples of applications for this invention include laying irrigation lines for farming, laying water lines for wetting coal piles (to allay dust), laying leaching solution distribution lines along the side slopes of ore stockpiles for mineral leaching, and the like.

The line laying aspect of the invention relates to laying fluid distribution lines along a surface via an overhead support cable. Such an aspect is particularly well suited for mining operations because it allows leaching solution distribution lines to be laid at substantially equal lateral spacings along the steep slopes of an ore stockpile.

During mining operations, large quantities of low grade mineralized material (e.g., low ore content material) may be removed from underground or open pit mines to gain access to high grade mineralized material (e.g., high ore content material) buried beneath the low grade mineralized material. This low grade mineralized material is typically stored in a large mound (hereinafter an "ore stockpile" or "stockpile") a short distance from the mining site. In the past, such ore stockpiles were believed to be of little commercial value and were often abandoned after a mine's high grade mineralized material was exhausted. Recently, however, the commercial value of abandoned ore stockpiles has been realized, such ore stockpiles now being known to contain many valuable minerals (particularly copper and similar metals).

To obtain minerals from an ore stockpile, the stockpile is substantially saturated with a leaching solution (i.e., sufficiently saturated to allow mineral extraction) which liquefies the minerals to be extracted, allowing the minerals to seep to the base of the ore stockpile where they may be collected. Typical leaching solutions used during mineral leaching operations include acids such as $H_2SO_4$ (for copper extraction) or water (the interaction of water with certain minerals within the ore stockpile forming an acid solution).

A common problem associated with ore stockpile mineral extraction (e.g., stockpile leaching) is providing the side slopes of large ore stockpiles with uniform and adequate leaching solution coverage so that all minerals that can be extracted are extracted. One way to achieve sufficient leaching solution coverage is to lay fluid distribution lines along the side slopes of an ore stockpile at substantially equal lateral spacings (i.e., sufficiently equal spacings to allow for adequate ore stockpile saturation with the minimum number of fluid distribution lines). Each mineral leaching fluid distribution line comprises a hose with a series of emitters equally spaced along the length of the fluid distribution line for releasing leaching solution onto the ore stockpile. By laying many fluid distribution lines along the slopes of an ore stockpile at substantially equal lateral spacings, the stockpile can be uniformly and completely saturated with leaching solution. Unfortunately, because ore stockpiles may be several hundred feet in height and have extremely steep slopes with rocky surface morphologies, laying fluid distribution lines along the side slopes of ore stockpiles is difficult. As a result, alternative techniques for distributing leaching solution along the slopes of ore stockpiles have been developed which do not employ fluid distribution lines, such as spraying the side slopes of stockpiles with high powered sprinklers. Spraying techniques, however, fail to provide adequate leaching solution saturation because of the high evaporation rate of airborne leaching solution, and provide poor coverage uniformity because of the inherent rough surface topography possessed by ore stockpiles. Further, spraying techniques may be hazardous to workers and the environment as the spraying of acid solutions throughout the air creates an acid mist that may travel substantial distances, especially during high winds.

A need therefore exists for an improved method and apparatus for laying fluid distribution lines along a surface. Within the mining industry, such a system will allow leaching solution distribution lines to be laid with substantially equal lateral spacings along the side slopes of an ore stockpile, thereby enhancing mineral recovery efficiency by providing more uniform and complete leaching solution saturation of the ore stockpile.

It is therefore an object of this invention to provide an improved method and apparatus for laying fluid distribution lines along a surface.

It is a more particular object of this invention to provide an improved method and apparatus for laying leaching solution distribution lines at substantially equal lateral spacings along the side slopes of an ore stockpile.

SUMMARY OF THE INVENTION

These and other objects of the invention are accomplished in accordance with the principles of the invention by providing a method and apparatus for laying fluid distribution lines along a surface. An overhead support cable is secured between a plurality of anchoring means (such as mobile boom trucks) spaced along the surface. A rotatable installation reel, comprising a drum (rigidly coupled to a plurality of drum flanges) which rotates about a center shaft, is then coupled to the overhead support cable by attaching a reel frame to the installation reel's center shaft and to the overhead support cable (via rotatable sheaves). A return cable is also coupled between one of the anchoring means and the reel frame. A coil of fluid distribution line (e.g., a coil of leaching solution distribution line), with a length preselected to span a length of the surface on which the fluid distribution line is to be laid, is then loaded on the drum of the installation reel. To facilitate the loading of a coil of fluid distribution line on the drum of the installation reel, the reel frame may be provided with a hinged side which pivots when detached from the drum's center shaft so that one of the drum flanges may be removed (providing access to the drum).

In operation, fluid distribution lines are laid along a surface by moving the installation reel along the overhead support cable (e.g., by moving the installation reel along the overhead support cable via the rotatable sheaves of the reel frame) so that the installation reel rotates to pay out the fluid distribution line onto the surface. (The terms "pay out" and "paying out" used herein refer to the letting out or supplying of a line or cable from a reel by unwinding the reel.) If, for example, fluid distribution lines are to be laid along a sloped surface by starting at the top of the sloped surface, moving of the installation reel is accomplished by paying out the return cable and allowing gravity to move the installation reel downwardly along the overhead support cable. Alternatively, if fluid distribution lines are to be laid along a level surface or along a sloped surface by starting at the bottom of the sloped surface, moving of the installation reel is accomplished by reeling in the return cable (e.g., with a winch) at the opposite end of the surface (i.e., adjacent one of the anchoring means in order to pull the installation reel along the overhead support cable toward the anchoring means).

Installation reel rotation is preferably achieved by fixing an end of the fluid distribution line which extends from the installation reel so that when the installation reel is moved along the overhead support cable the fluid distribution line causes the installation reel to rotate. In this manner, the fluid distribution line pays out onto the surface. To assist in the paying out of fluid distribution line, the installation reel may be provided with a brake which provides a substantially constant installation reel rotation speed.

After laying one fluid distribution line, subsequent fluid distribution lines may be laid at any desired spacings (e.g., substantially equal lateral spacings) by laterally shifting each anchoring means prior to laying each subsequent length of fluid distribution line, or alternatively, by moving a portion of each anchoring means prior to laying each length of fluid distribution line. For example, when a mobile boom truck is used as an anchoring means which couples to the overhead support cable by a boom and to the return cable by a winch, a portion of an anchoring means may be moved laterally by rotating the boom of the truck and sliding the winch along rails attached to the bed of the truck.

Further features of the invention, its nature and various advantages, will be more apparent from the accompanying drawings and the following detailed description of the preferred embodiments.

DETAILED DESCRIPTION OF THE PREFERRED EMBODIMENTS

Figure 1:
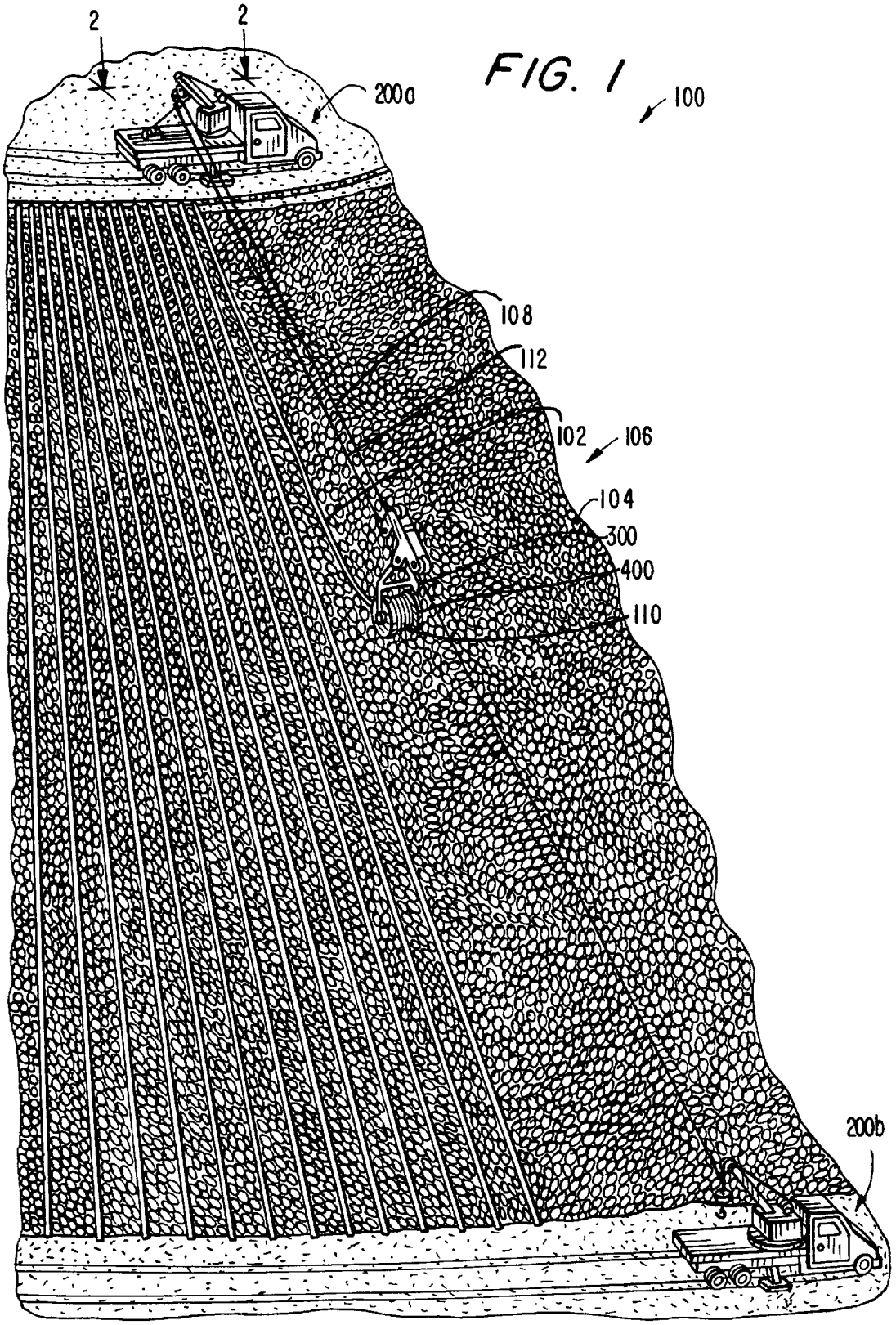
FIG. 1 is a simplified perspective view of illustrative fluid distribution line laying apparatus in accordance with this invention.

In the illustrative embodiment shown in FIG. 1, a fluid distribution line laying apparatus 100 constructed in accordance with this invention is used to lay fluid distribution line 102 along a side slope 104 of an ore stockpile 106. An overhead support cable 108 is secured above side slope 104 by coupling overhead support cable 108 between a dual-winch mobile boom truck 200*a* (located adjacent the top of ore stockpile 106) and a single-winch mobile boom truck 200*b* (located adjacent the bottom of ore stockpile 106). While overhead support cable 108 is shown coupled between two mobile boom trucks 200*a*, 200*b*, it will be understood that any anchoring means may be used to secure overhead support cable 108 above side slope 104. Coupled to overhead support cable 108 via a reel frame 300 is a rotatable installation reel 400 containing a coil 110 of fluid distribution line 102. In addition, a return cable 112 is coupled between dual-winch mobile boom truck 200*a* and reel frame 300.

Figure 2:
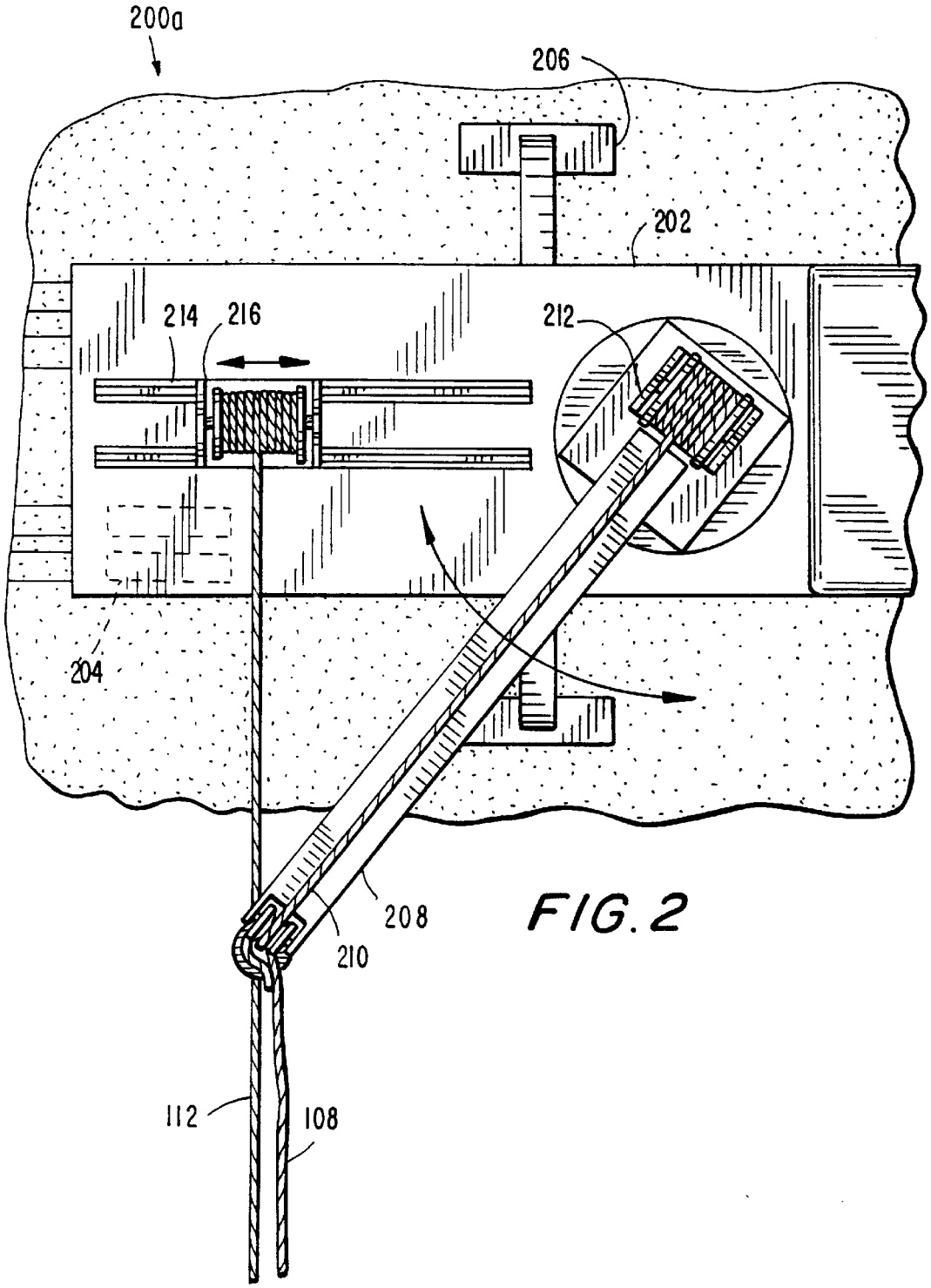
FIG. 2 is an enlarged perspective view of a mobile boom truck anchoring means of the line laying apparatus of FIG. 1 taken along line 2—2 in FIG. 1.

FIG. 2 shows an enlarged view of dual-winch mobile boom truck 200*a* which includes a truck bed 202 coupled to the surface of ore stockpile 106 (not shown) by wheels 204 and stabilizing members 206. Truck 200*a* also has a boom 208, a boom winch 212 (for reeling in and paying out a boom cable 210 operatively coupled between boom winch 212 and boom 208), and return cable winch rails 214 mounted on truck bed 202. Slidably mounted on return cable winch rails 214 is a return cable winch 216 for reeling in and paying out return cable 112. Overhead support cable 108 is attached to boom cable 210 so that boom winch 212 may be used to tighten overhead support cable 108 (by reeling in boom cable 210) or to slacken overhead support cable 108 (by paying out boom cable 210).

Single-winch mobile boom truck 200*b* of FIG. 1 is similarly configured with a boom 208, a boom cable 210 (coupled to a portion of overhead support cable 108), and a boom winch 212 (for tightening and slackening overhead support cable 108 by reeling in and paying out boom cable 210, respectively). Preferably, single-winch mobile boom truck 200*b* does not contain return cable winch rails 214 and a return cable winch 216 (as shown in FIG. 1) because return cable 112 is not coupled to single-winch mobile boom truck 200*b*.

Figure 3A:
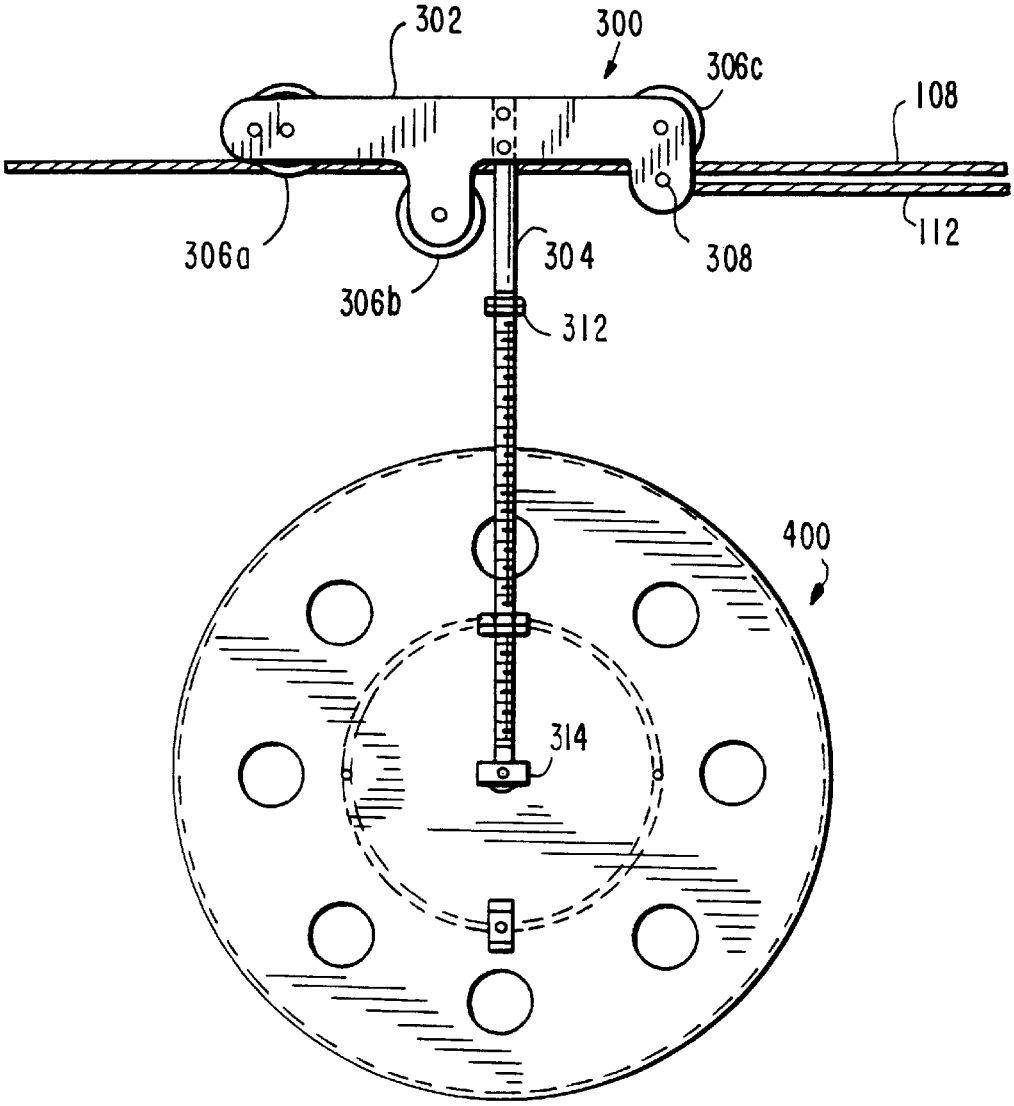
FIG. 3A is a side elevational view of a reel frame and installation reel of the line laying apparatus of FIG. 1.
Figure 3B:
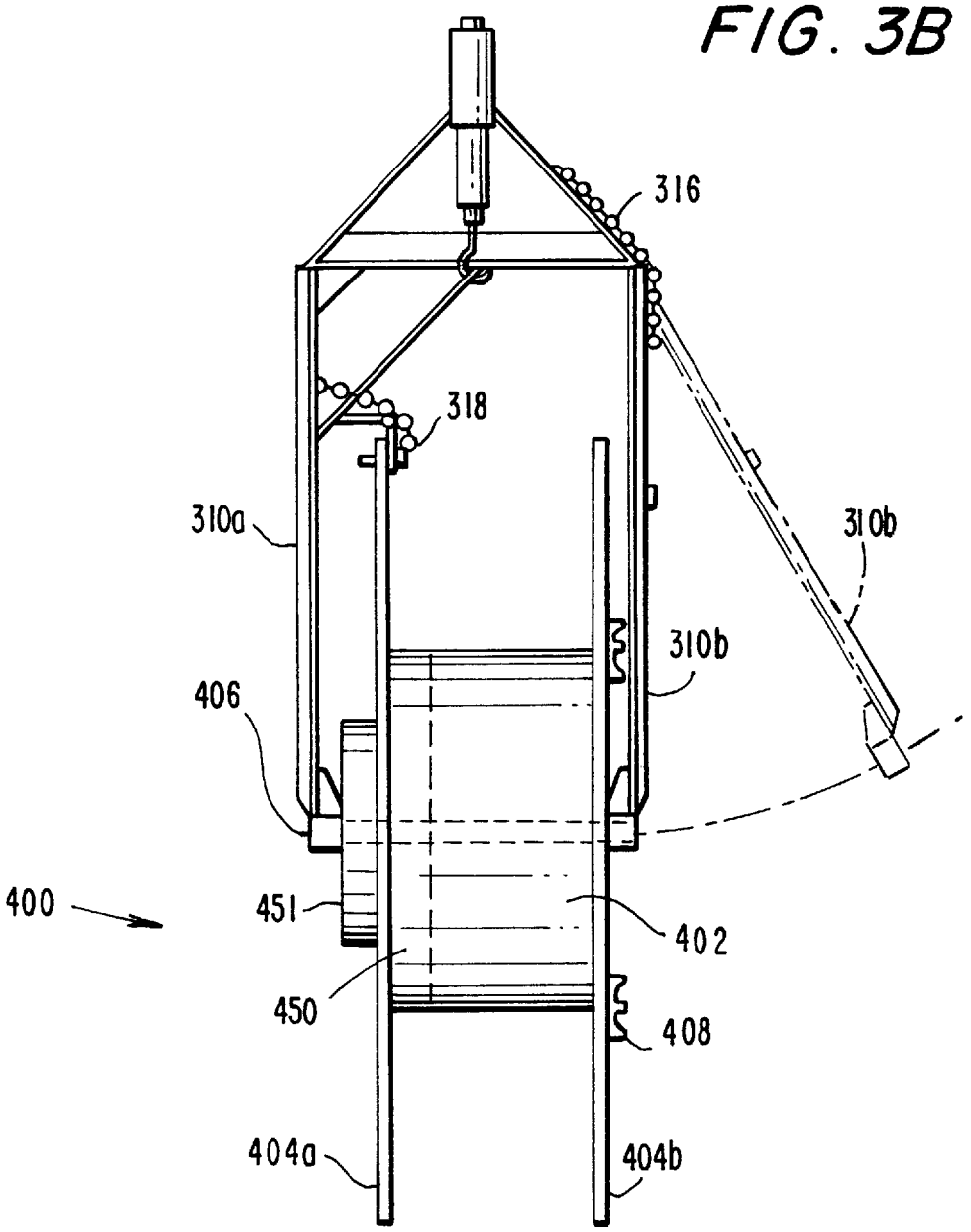
FIG. 3B is a front elevational view of the reel frame and installation reel of FIG. 3A.

FIG. 3A is a side elevational view of reel frame 300 attached to installation reel 400. Reel frame 300 comprises a sheave frame 302 coupled to a reel support 304. Sheave frame 302 supports rotatable sheaves 306*a–c* which engage overhead support cable 108 (thus coupling reel frame 300 and installation reel 400 to overhead support cable 108) by, for example, threading overhead support cable 108 below rotatable sheave 306*a*, above rotatable sheave 306*b*, and below rotatable sheave 306*c*. Also provided on sheave frame 302 is a return cable bolt 308 for coupling return cable 112 to reel frame 300. Reel support 304 is also attached to sheave frame 302 and comprises a fixed side 310*a* (FIG. 3B) and a hinged side 310*b* for coupling to installation reel 400. Hinged side 310*b* is attached to reel support 304 via a hinge 312 (FIG. 3A) which allows hinged side 310*b* to pivot as shown in FIG. 3B.

Installation reel 400 comprises a drum 402 rotatably coupled to a center shaft 406, rigidly coupled to a fixed drum flange 404*a*, and releasably coupled to a releasable drum flange 404*b* via wingnuts 408. Installation reel 400 also includes a braking mechanism 450 (described below in connection with FIGS. 4A and 4B) for limiting speed of rotation of drum 402 about center shaft 406. A brake cover 451 provides access to braking mechanism 450.

Installation reel 400 is coupled to reel frame 300 by attaching fixed side 310*a* of reel support 304 to one end of center shaft 406 and hinged side 310*b* of reel support 304 to the opposite end of center shaft 406 (via a detachable retaining bolt 314). Accordingly, to load a coil 110 of fluid distribution line 102 on installation reel 400, detachable retaining bolt 314 is removed from center shaft 406 and hinged side 310*b* is pivoted upward to provide access to installation reel 400 (as seen in FIG. 3B). A first safety chain 316 is provided for holding hinged side 310*b* up and out of the way during the loading process. (A second safety chain 318 is also provided for preventing the rotation of installation reel 400.) Once hinged side 310*b* has been pivoted upward, releasable drum flange 404*b* is detached from drum 402 by removing wingnuts 408. A coil 110 of fluid distribution line 102 is then placed on drum 402, drum flange 404*b* is reattached to drum 402 via wingnuts 408, and hinged side 310*b* is secured to center shaft 406 with detachable retaining bolt 314.

Figure 4A:
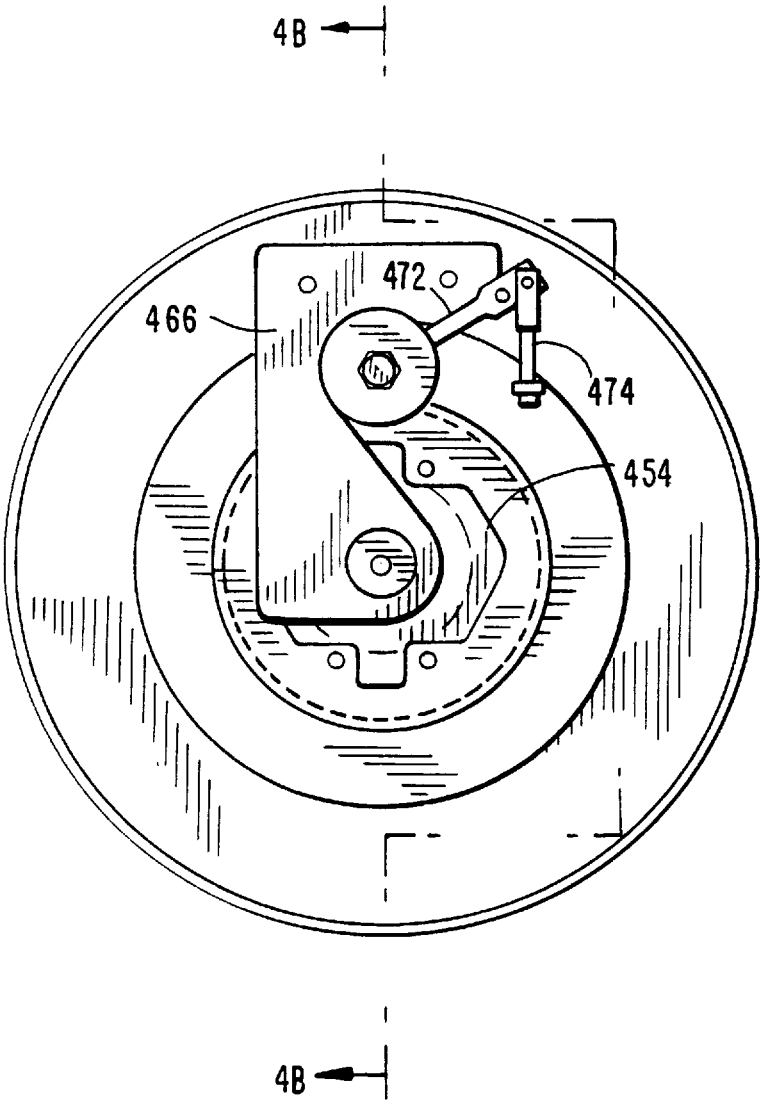
FIG. 4A is a side elevational view of an illustrative braking mechanism usable in the installation reel of FIG. 3A.
Figure 4B:
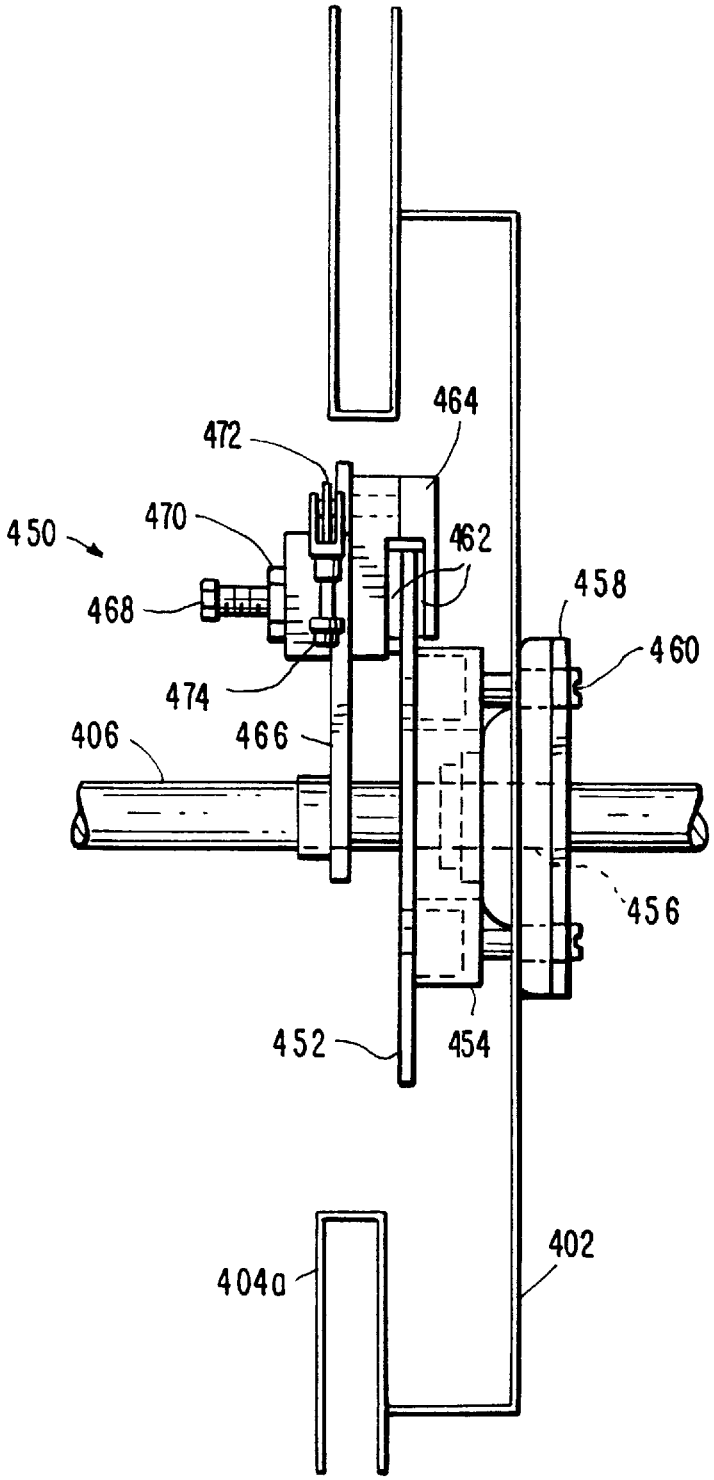
FIG. 4B is a sectional view of the braking mechanism of FIG. 4A taken along line 4B—4B in FIG. 4A.

FIGS. 4A and 4B show illustrative drum braking mechanism 450 in more detail. With reference to FIG. 4B, braking mechanism 450 includes a rotor 452 coupled to drum 402 with a spacer disc 454, a flange bearing 456, a bearing sole plate 458, and cap screws 460, as well as brake pads 462 coupled to center shaft 406 with a caliper 464 and a caliper bracket 466. Flange bearing 456 is rotatably coupled to center shaft 406 and rigidly couple to drum 402 and bearing sole plate 458 via cap screws 460 so that bearing sole plate 458, flange bearing 456, and drum 402 mutually rotate about center shaft 406. As well, spacer disc 454 is rigidly coupled to bearing sole plate 458, flange bearing 456, and drum 402 by cap screws 460, and is further rigidly coupled to rotor 452 so that rotor 452 rotates about center shaft 406 with drum 402.

Caliper 464 comprises a brake adjustment bolt 468 for adjusting the location of brake pads 462 with respect to rotor 452, and a locking nut 470 for maintaining the position of brake adjustment bolt 468. Brake pads 462 are brought into contact with rotor 452 by a brake tension lever 472 (FIG. 4A) which adjusts the position of brake pads 462 within the range permitted by brake adjustment bolt 468. A weighted yoke 474 coupled to brake tension lever 472 exerts a gravitational force on brake tension lever 472 so that brake pads 462 are brought into contact with rotor 452. As brake pads 462 wear, brake adjustment bolt 468 and locking nut 470 can be adjusted to position brake pads 462 closer to rotor 452 in order to ensure that a constant braking pressure is applied to rotor 452 by brake pads 462.

The operation of laying fluid distribution line 102 along side slope 104 of ore stockpile 106 will now be described. A coil 110 of fluid distribution line 102 is loaded on installation reel 400 by pivoting hinged side 310*b* of reel frame 300 away from center shaft 406 and by removing releasable drum flange 404*b* from drum 402 to provide access to drum 402 (as previously described). Once loaded with coil 110, releasable drum flange 404*b* and hinged side 310*b* are reattached and installation reel 400 is moved along overhead support cable 108 via rotatable sheaves 306*a–c* so that installation reel 400 rotates to pay out fluid distribution line 102 onto side slope 104. Preferably installation reel 400 is rotated by fixing an end of fluid distribution line 102 which extends from installation reel 400 so that when installation reel 400 is moved along overhead support cable 108 fluid distribution line 102 causes installation reel 400 to rotate and to pay out fluid distribution line 102 onto side slope 104.

Paying out of fluid distribution line 102 along side slope 104 is performed controllably by limiting the speed of rotation of installation reel 400 with braking mechanism 450. Braking mechanism 450 provides a substantially constant speed of rotation for installation reel 400, allowing installation reel 400 to controllably rotate regardless of changes in the reel-in or pay-out speed of return cable 112. That is, installation reel 400 will only rotate if a rotational force is present which counteracts the braking force produced by braking mechanism 450. In this manner, when the speed at which return cable 112 is paid out or reeled in changes, the speed of rotation of installation reel 400 similarly changes so that no excess fluid distribution line 102 is laid on side slope 104 (i.e., fluid distribution line 102 remains taut at all times).

If fluid distribution line 102 is to be laid along side slope 104 by starting adjacent the top of side slope 104, moving of installation reel 400 is accomplished by paying out return cable 112 (via return cable winch 216 of dual-winch mobile boom truck 200*a* located adjacent the top of side slope 104) and allowing gravity to move installation reel 400 along support cable 108. Alternatively, if fluid distribution line 102 is to be laid by starting adjacent the bottom of side slope 104, moving of installation reel 400 is accomplished by reeling in return cable 112 (via return cable winch 216 of dual-winch mobile boom truck 200*a*) in order to pull installation reel 400 along overhead support cable 108 toward dual-winch mobile boom truck 200*a*.

After laying a first fluid distribution line 102 as described above, subsequent fluid distribution lines are laid at substantially equal lateral spacings (i.e., lateral spacings sufficiently equal to allow for adequate saturation of ore stockpile 106 with the minimum number of fluid distribution lines 102) by either laterally shifting dual-winch mobile boom truck 200*a* and single-winch mobile boom truck 200*b* by the desired lateral spacing prior to laying each subsequent fluid distribution line 102, or by rotating boom 208 of dual-winch mobile boom truck 200*a* and boom 208 of single-winch mobile boom truck 200*b* and sliding return cable winch 216 along return cable winch rails 214 so as to laterally shift overhead support cable 108 and return cable 112 the desired lateral spacing prior to laying each subsequent fluid distribution line 102. In a preferred embodiment, uniform and adequate saturation of ore stockpile 106 is achieved by spacing fluid distribution lines 102 approximately 3–4 feet apart. Furthermore, preferably several (e.g., five) fluid distribution lines 102 are laid prior to moving mobile boom trucks 200*a*, 200*b* by rotating boom 208 of each mobile boom truck and by sliding return cable winch 216 along return cable winch rails 214 before laying each successive fluid distribution line 102. This reduces the number of times mobile boom trucks 200*a*, 200*b* must be moved (reducing the number of times stabilizing members 206 must be raised and lowered) and thereby increases the rate at which fluid distribution lines may be laid.

Accordingly, the present invention allows fluid distribution lines to be laid at substantially equal lateral spacings along the steep slopes of an ore stockpile, and as such allows increased mineral extraction efficiency by enabling such slopes to be more uniformly and completely saturated with leaching solution than was previously possible. Additionally, by using fluid distribution lines, a side slope may be selectively leached (e.g., to prevent the slumping or the collapse of unstable portions of the ore stockpile) by turning off the leaching solution supply to relevant fluid distribution lines.

It will be understood that the foregoing is only illustrative of the principles of the invention, and that various modifications can be made by those skilled in the art without departing from the scope and spirit of the invention. For example, while mobile boom trucks are used as anchoring means in the above-described embodiments, any other anchoring means may be employed. Similarly, more than one coil 110 of fluid distribution line 102 may be loaded on installation eel 400, and the manner of interconnecting the several components comprising fluid distribution line laying apparatus 100 may be varied. Finally, while the preferred embodiment has been disclosed in the context of leaching ore stockpiles, any application wherein fluid distribution lines are laid along a surface may benefit from the disclosed invention.

The invention claimed is:

1. A method for laying fluid distribution lines along a surface comprising:

securing an overhead cable above said surface between a plurality of anchoring means;

coupling a rotatable installation reel to said overhead cable;

loading a fluid distribution line on said installation reel; and moving said installation reel along said overhead cable so that said installation reel rotates to pay out said fluid distribution line onto said surface as said installation reel moves along said overhead cable.

2. The method defined in claim 1 wherein said fluid distribution lines are leaching solution distribution lines.

3. The method defined in claim 1 wherein said surface is a side slope of an ore stockpile.

4. The method defined in claim 3 wherein a first of said anchoring means is located adjacent a top of said ore stockpile.

5. The method defined in claim 4 wherein a second of said anchoring means is located adjacent a bottom of said ore stockpile.

6. The method defined in claim 1 wherein, after said moving, said method further comprises:

relocating at least one of said anchoring means; and repeating said moving to pay out additional fluid distribution line onto said surface at a location which is laterally spaced from the fluid distribution line paid out during the earlier performance of said moving.

7. The method defined in claim 1 wherein, prior to said loading, said method further comprises:

pre-selecting a length of said fluid distribution line which will span a predetermined length of said surface, said length of said fluid distribution line being the fluid distribution line which is loaded on said installation reel during said loading.

8. The method defined in claim 1 wherein said moving is gravitationally assisted.

9. The method defined in claim 1 wherein said moving comprises:

attaching a return cable to said installation reel; and reeling in said return cable adjacent one of said anchoring means in order to pull said installation reel along said overhead cable toward said one of said anchoring means.

10. The method defined in claim 1 wherein, prior to said moving, said method comprises:

fixing an end of said fluid distribution line which extends from said installation reel so that when said moving is performed, said fluid distribution line causes said installation reel to rotate.

11. An apparatus for laying fluid distribution lines along a surface comprising:

a plurality of anchoring means;

an overhead support cable above said surface operatively coupled between said anchoring means;

a reel frame operatively coupled to said support cable for movement along said support cable;

a return cable operatively coupled between said reel frame and one of said anchoring means; and a rotatable installation reel operatively coupled to said reel frame for supporting a coil of fluid distribution line, said installation reel being rotatable to pay out said fluid distribution line from said coil onto said surface as said reel frame and installation reel move along said support cable.

12. The apparatus defined in claim 11 wherein said fluid distribution lines are leaching solution distribution lines.

13. The apparatus defined in claim 11 wherein said surface is a side slope of an ore stockpile.

14. The apparatus defined in claim 13 wherein a first of said anchoring means is located adjacent a top of said ore stockpile.

15. The apparatus defined in claim 14 wherein a second of said anchoring means is located adjacent a bottom of said ore stockpile.

16. The apparatus defined in claim 11 wherein a first of said anchoring means is a mobile anchoring means.

17. The apparatus defined in claim 16 wherein said first anchoring means is a mobile boom truck.

18. The apparatus defined in claim 11 wherein said plurality of anchoring means comprises:

a first anchoring means comprising a first base coupled to said surface, a first overhead cable support coupled to said first base and a first portion of said support cable, and a return cable reel coupled to said first base and a portion of said return cable, both said first overhead cable support and said return cable reel being moveable relative to said first base; and a second anchoring means comprising a second base coupled to said surface and a second overhead cable support coupled to said second base and a second portion of said support cable, said second overhead cable support being moveable relative to said second base.

19. The apparatus defined in claim 11 wherein said reel frame is coupled to said support cable via a plurality of rotatable sheaves.

20. The apparatus defined in claim 11 wherein said rotatable installation reel comprises:

a center shaft;

a drum rotatably coupled to said center shaft; and a plurality of drum flanges rigidly coupled to said drum, a first of said drum flanges being releasably coupled to said drum for facilitating loading said coil of fluid distribution line onto said drum.

21. The apparatus defined in claim 20 wherein said reel frame is coupled to said center shaft of said installation reel and wherein said reel frame further comprises:

a hinged side for pivoting when released from said center shaft wherein pivoting said hinged side allows said first drum flange to be released from said drum in order to allow said coil of fluid distribution line to be loaded on said drum.

22. The apparatus defined in claim 20 further comprising:

a drum brake for limiting speed of rotation of said drum about said center shaft.

23. The apparatus defined in claim 22 wherein said drum brake comprises:

a rotor coupled to said drum; and a brake pad coupled to said center shaft and contacting said rotor.

24. The apparatus defined in claim 23 wherein a caliper couples said brake pad to said center shaft.

25. A method for enhanced mineral recovery from an ore stockpile wherein leaching solution distribution lines are laid at substantially equal lateral spacings along a slope of said ore stockpile, said method comprising:

securing an overhead cable above said slope between a first and a second anchoring means;

coupling a rotatable installation reel to said overhead cable;

loading a leaching solution distribution line on said installation reel;

moving said installation reel along said overhead cable so that said installation reel rotates to pay out said leaching solution distribution line onto said slope as said installation reel moves along said overhead cable;

laterally shifting said first and second anchoring means; and repeating said method from said loading to said laterally shifting until said slope is covered with leaching solution distribution lines with substantially equal lateral spacings.

26. The method defined in claim 25 wherein, prior to said loading, said method further comprises:

pre-selecting a length of said leaching solution distribution line which will span a predetermined length of said slope, said length of said leaching solution distribution line being the leaching solution distribution line which is loaded on said installation reel during said loading.

27. The method defined in claim 25 wherein said moving is gravitationally assisted.

28. The method defined in claim 25 wherein said moving comprises:

attaching a return cable to said installation reel; and reeling in said return cable adjacent one of said anchoring means in order to pull said installation reel along said overhead cable toward said one of said anchoring means.

29. The method defined in claim 25 wherein, prior to said moving, said method comprises:

fixing an end of said leaching solution distribution line which extends from said installation reel so that when said moving is performed, said leaching solution distribution line causes said installation reel to rotate.

* * * * *